US006942492B2

(12) United States Patent
Alvarez et al.

(10) Patent No.: US 6,942,492 B2
(45) Date of Patent: Sep. 13, 2005

(54) FLEXIBLE CONTACT CONNECTOR

(75) Inventors: Joseph Alvarez, Avoca, MI (US); Morgan Wireman, Berkley, MI (US)

(73) Assignee: Lionel L.C.C., Chesterfield, MI (US)

( * ) Notice: Subject to any disclaimer, the term of this patent is extended or adjusted under 35 U.S.C. 154(b) by 0 days.

(21) Appl. No.: 10/802,226

(22) Filed: Mar. 17, 2004

(65) Prior Publication Data

US 2004/0182812 A1 Sep. 23, 2004

Related U.S. Application Data

(60) Provisional application No. 60/455,180, filed on Mar. 17, 2003.

(51) Int. Cl.[7] ..... H01R 12/00
(52) U.S. Cl. ..... 439/65; 439/34; 439/289
(58) Field of Search ..... 439/65, 34, 289–292

(56) References Cited

U.S. PATENT DOCUMENTS

| | | | | |
|---|---|---|---|---|
| 864,222 | A | | 8/1907 | Bates |
| 1,319,311 | A | | 10/1919 | Tomlinson |
| 1,692,297 | A | | 11/1928 | Good |
| 1,874,228 | A | | 8/1932 | Becker |
| 1,914,323 | A | | 6/1933 | Boisselier |
| RE18,981 | E | | 10/1933 | Boisselier |
| 1,974,326 | A | | 9/1934 | Boisselier |
| 2,002,358 | A | | 5/1935 | Smith |
| 2,019,690 | A | | 11/1935 | McKeige |
| 2,106,698 | A | | 2/1938 | Bonanno |
| 2,223,905 | A | | 12/1940 | Beyer et al. |
| 2,232,508 | A | | 2/1941 | Bonanno |
| 2,617,541 | A | | 11/1952 | Goode |
| 3,664,060 | A | | 5/1972 | Longnecker |
| 3,822,501 | A | | 7/1974 | Kelterstr |
| 3,868,909 | A | | 3/1975 | Pelabon |
| 4,869,670 | A | * | 9/1989 | Ueda et al. ..... 439/34 |
| 5,127,869 | A | | 7/1992 | Hanzawa |
| 5,423,439 | A | * | 6/1995 | Richter ..... 213/75 TC |
| 5,427,561 | A | * | 6/1995 | Eichhorn et al. ..... 446/463 |
| 5,449,295 | A | | 9/1995 | Hanano et al. |
| 5,826,736 | A | | 10/1998 | Weber |
| 6,159,069 | A | * | 12/2000 | Grapp ..... 446/438 |

FOREIGN PATENT DOCUMENTS

| | | |
|---|---|---|
| DE | 003924219 A1 | 1/1991 |
| DE | 003934818 A1 | 4/1991 |
| DE | 004042013 A1 | 7/1992 |
| DE | 004416807 A1 | 9/1994 |

* cited by examiner

*Primary Examiner*—Truc Nguyen
(74) *Attorney, Agent, or Firm*—O'Melveny & Myers LLP

(57) ABSTRACT

A flexible connector for use in a model train is provided. The flexible connector includes a first coupling member associated with a first train car, and a second coupling member associated with a second train car, wherein the second coupling member is configured for engagement with the first coupling member. The flexible connector further includes a first layer of electrically conductive material connected to a first circuit and disposed on the surface of the first coupling member. The flexible connector still further includes a second layer of electrically conductive material connected to a second circuit and disposed on the surface of the second coupling member such that the first and second train cars are mechanically and electrically connected when the first and second coupling members are engaged.

17 Claims, 8 Drawing Sheets

FLEXIBLE CONTACT CONNECTOR

CROSS REFERENCE TO RELATED APPLICATIONS

This application claims the benefit of U.S. Provisional Patent Application No. 60/455,180 filed Mar. 17, 2003, which is hereby incorporated by reference in its entirety.

BACKGROUND OF THE INVENTION

1. Technical Field

This invention relates generally to electric powered models, for example, model trains, and more particularly to a flexible contact connector for coupling a pair of models together.

2. Discussion of the Related Art

It is known to provide an electric powered model, such as a model train, that draws its power from rails of a track, which is in turn powered by a power source. In a particular model train system, a so-called three rail track is provided wherein power, such as AC power, is applied across the rails of the track. The center or middle track rail is coupled to the "hot" or power terminal of the power source, while the ground or neutral terminal is coupled to the outside track rail.

A locomotive model train or the like draws its power from the track rails. To complete an electric circuit, the locomotive must make good, electrical contact with both the center track rail and the outside track rail. It should be noted that there are a wide variety of locomotive configurations, for example, some with no trucks and/or with "rubber" covered wheels to improve traction but which provides an electrical insulating effect. In any event, through a variety of configurations, the number of electricity conducting axles may be reduced, perhaps to only one. In such circumstance, when the locomotive traverses a section of track that is "dead" due to an open circuit condition or due to dirt or other electrical insulating material on the outside ("ground" or neutral) track rail, the electric powered locomotive may have its electrical circuit "broken" which may cause the electric motor to discontinue torque production momentarily until the electric powering circuit is re-established.

It is also known to couple electrical signals between the locomotive and a tender using wires from each terminating in complementary connectors.

There are, however, numerous shortcomings with respect existing mechanical and electrical coupling arrangements. For instance, existing arrangements require separate mechanical and electrical connections to couple a pair of train cars together, such as, for example purposes only, a locomotive to a tender or two tenders together. Additionally, extra hard wire connections are often times required in order to electrically connect the circuit(s) of the train cars so that signals such as power, ground and other similar electric pulses can be transmitted therebetween.

Accordingly, a need exists for a coupling means that minimizes and/or eliminates one or more of the above identified deficiencies.

SUMMARY OF THE INVENTION

The invention provides an easy car-to-car connection without the need for an extra hardwire connection(s) to transmit signals, such as power, ground or other electrical signals between two or more electric toy train cars.

Flexible conductive material on one train car (such as a locomotive or a tender) makes contact with corresponding conductive material on the adjacent, next train car completing an electrical/electronic circuit(s). Once two or more train cars are coupled together, the flexible contact(s) between the train cars is such that the electronic circuit(s) will remain in contact through typical use until the cars are uncoupled. In one embodiment, a locomotive obtains an electrical connection to "ground" through this flexible connector to an adjacent train car, which in turn gets ground from its own wheel/axle contacts with the outside track rail. This arrangement improves the robustness of operation, even for locomotives having a minimal configuration for connecting to the ground track rail, for example, a locomotive with no trucks and all but one axle is rubberized for traction. In still a further embodiment, the flexible connector includes an aperture to allow IR communication between the locomotive and the train car. Electrical signals other than ground may be communicated by the inventive connection, including but not limited to power and/or control signals. In addition, the invention may also be used in DC powered systems.

Accordingly, a flexible connector is presented. The flexible connector includes a first and a second coupling member associated with a first and a second model train car, respectively, wherein the second coupling member is configured for engagement with the first coupling member. The flexible connector further includes a first layer of flexible electrically conductive material connected to a first circuit and disposed upon the surface of the first coupling member. The flexible connector still further includes a second layer of flexible electrically conductive material connected to a second circuit and disposed upon the surface of the second coupling member. This arrangement allows for the first and second model train cars to be mechanically and electrically connected when the first and second coupling members are engaged with each other.

A method of powering an electric train is also provided.

DETAILED DESCRIPTION OF THE INVENTION

Figure 1A:
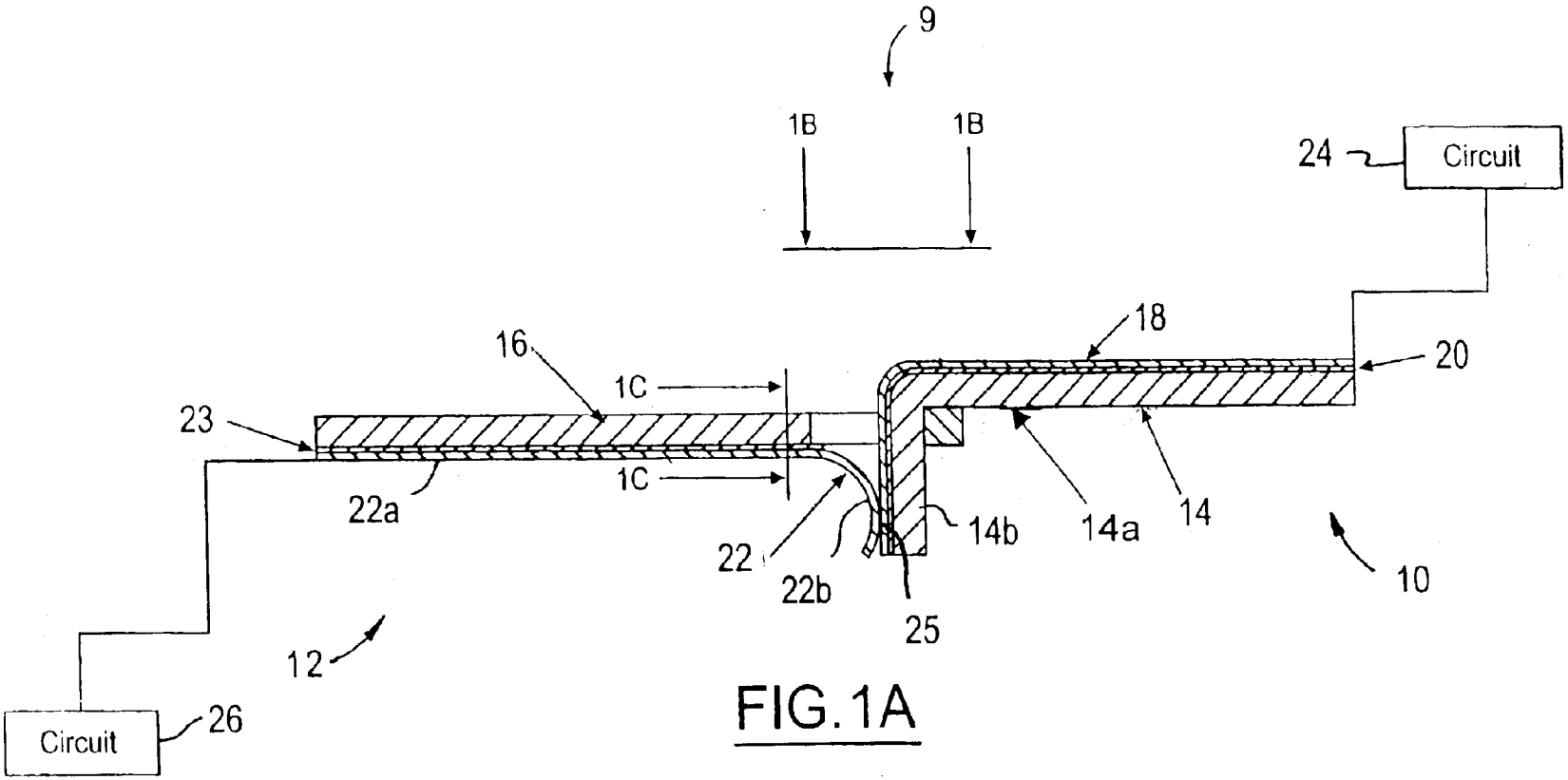
FIG. 1A is a side view of an exemplary embodiment of a flexible contact connector in accordance with the present invention.

Referring now to the drawings wherein like reference numerals are used to identify identical components in the various views, FIG. 1A shows a first exemplary embodiment of a flexible contact connector, designated as reference numeral 9. Connector 9 provides an electrical and mechanical connection between a first model train car, such as a locomotive car 10, and a second model train car, such as a tender car 12. It should be noted that while connector 9 can be used to couple a locomotive and tender together, connector 9 is not limited to this configuration. In reality, connector 9 can be used to couple, for example, two locomotives, two tenders, etc. together. FIG. 1A further shows a first coupling member 14 associated with locomotive 10, and a second coupling member 16 associated with tender car 12. First and second coupling members 14 and 16 shown in FIG. 1A are of the drawbar type.

First coupling member 14 includes a horizontal portion 14*a* having a top and a bottom side, and a vertical portion 14*b* having an inner and an outer side. Vertical portion 14*b* is located at a distal end of horizontal portion 14*a*, and is configured to be perpendicular therewith so as to form a generally J-shaped drawbar. First coupling member 14 further includes a layer of electrically conductive material 18 disposed on the upper and the outer sides of portions 14*a* and 14*b*, respectively. First coupling member 14 may further include a layer of electrically insulating material 20 disposed between conductive layer 18 and the upper and outer sides of coupling member 14, as shown. Electrically conductive material 18 and electrically insulating material 20 may comprise conventional materials known in the art. For example, material 18 may comprise copper or its alloys.

Figure 1C:
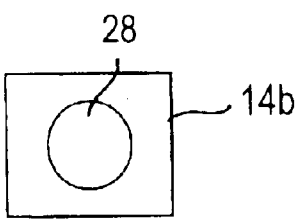
FIG. 1C is front view of a portion of the flexible contact connector of FIG. 1 along the lines 1C—1C in FIG. 1.
Figure 1B:
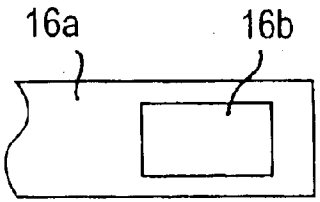
FIG. 1B is a top view of a portion of the flexible contact connector of FIG. 1 along the lines 1B—1B in FIG. 1.

Second coupling member 16 comprises a horizontal portion 16*a* having a top and a bottom side, and further has a through-aperture 16*b* on a distal end thereof (best shown in FIG. 1B). Portion 14*b* and aperture 16*b* are configured in a complementary manner in both size and shape so that portion 14*b* may be disposed in aperture 16*b*, as shown in FIG. 1A. Second coupling member 16 further includes a second layer of flexible, resilient, electrically conductive material 22 disposed on the bottom side thereof. Conductive layer 22 includes a straight, horizontally-disposed portion 22*a* that extends into an arcuate portion 22*b* thereby forming a generally J-shaped item 22. Conductive layer 22 may comprise phosphor bronze material for its suitability with respect to springiness, and ability for elastic deformation (i.e., that will retain its shape). Second coupling member 16 may still further include a second layer of electrically insulating material 23 disposed between conductive material 22 and the bottom side of second coupling member 16, as shown.

The arcuate portion 22*b* of conductive layer 22 that projects into aperture 16*b* is such that electrical contact is made at 25 between the layers of electrically conducting material 18 and 22. Connection point 25 provides electrical connectivity between a circuit 24 (e.g., a ground input for a motor drive or motor input terminal) and a circuit 26 (e.g., a coupling to the ground track rail such as a truck axle via a conductive wheel). Of course, other power and/or control signals may be passed via flexible connection 9 relating to various electronics (e.g., circuits 24 and 26).

With reference to FIGS. 1A and 1C, first coupling member 14, and portion 14*b* in particular, has a second through aperture 28 therein suitable for use in an alternate embodiment. Aperture 28 is configured to allow transmission of infrared (IR) signals from an IR transmitter (not shown) associated with locomotive 10 to an IR receiver (not shown) associated with tender 12. Messages can be carried by the IR transmitter/receiver, as known.

Figures 2, 3, 4:
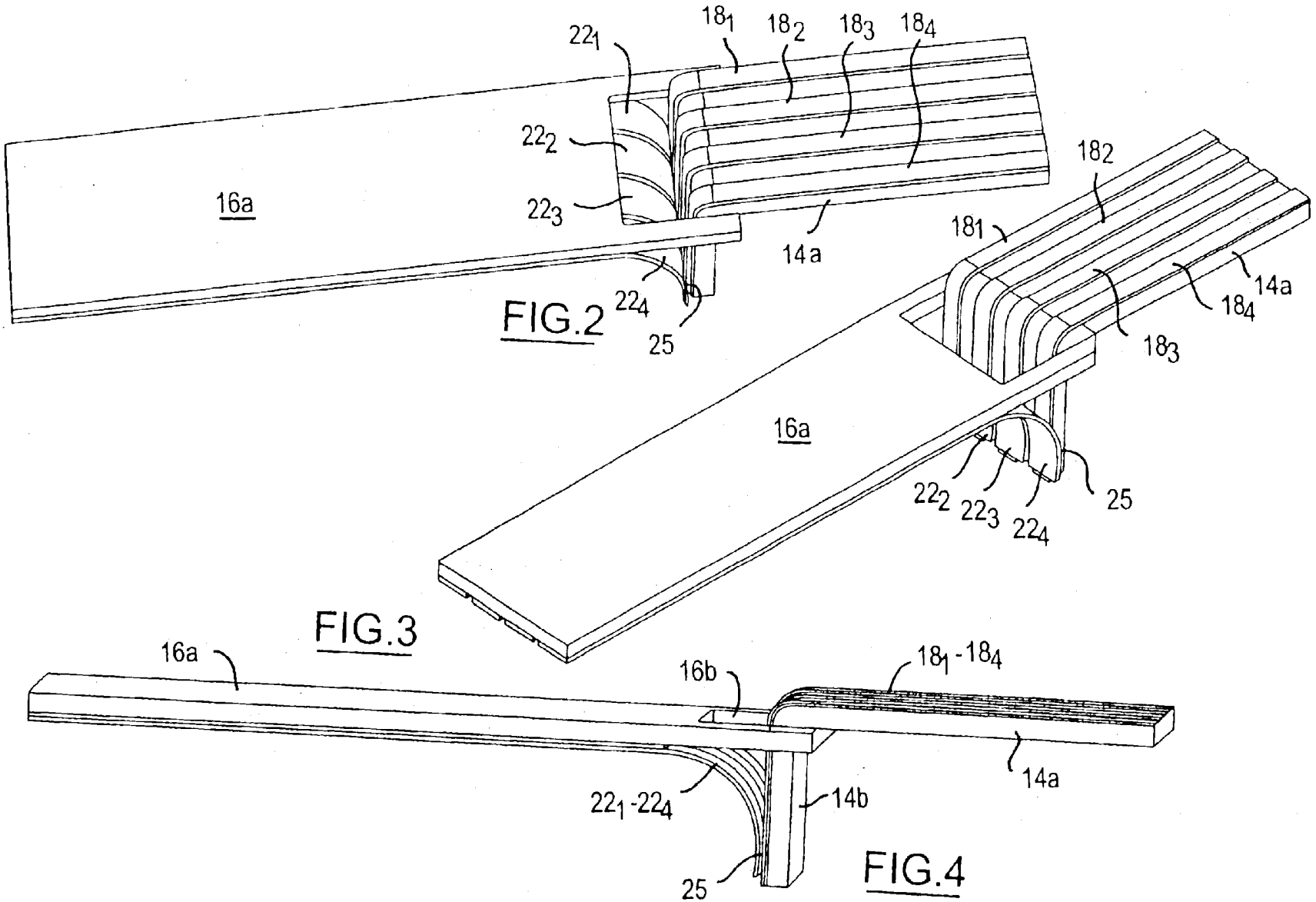
FIG. 2 is a first perspective view of the flexible contact connector of FIG. 1.
FIG. 3 is a second perspective view of the flexible contact connector of FIG. 1.
FIG. 4 is a third perspective view of the flexible contact connector of FIG. 1.
Figure 5:
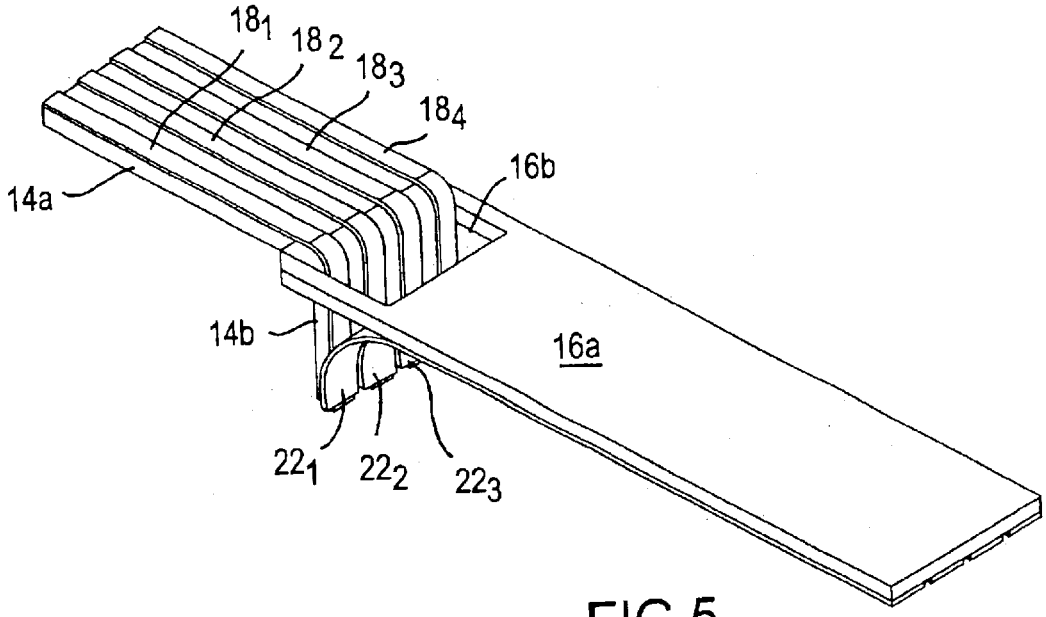
FIG. 5 is a fourth perspective view of the flexible contact connector of FIG. 1.
Figure 6:
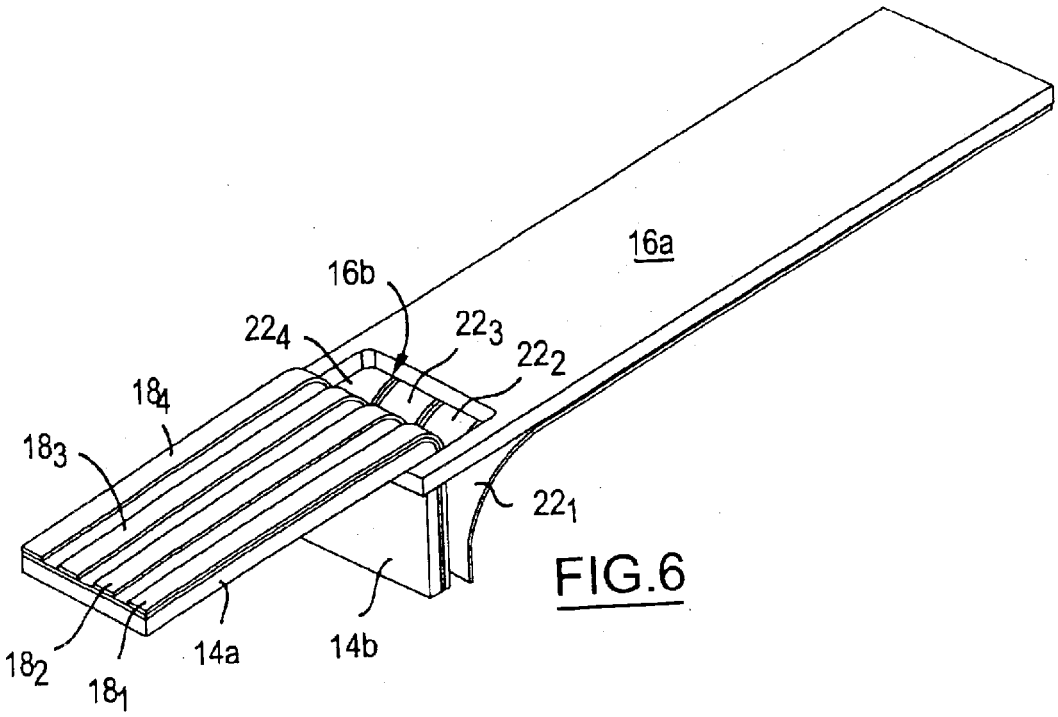
FIG. 6 is a fifth perspective view of the flexible contact connector of FIG. 1.
Figure 7:
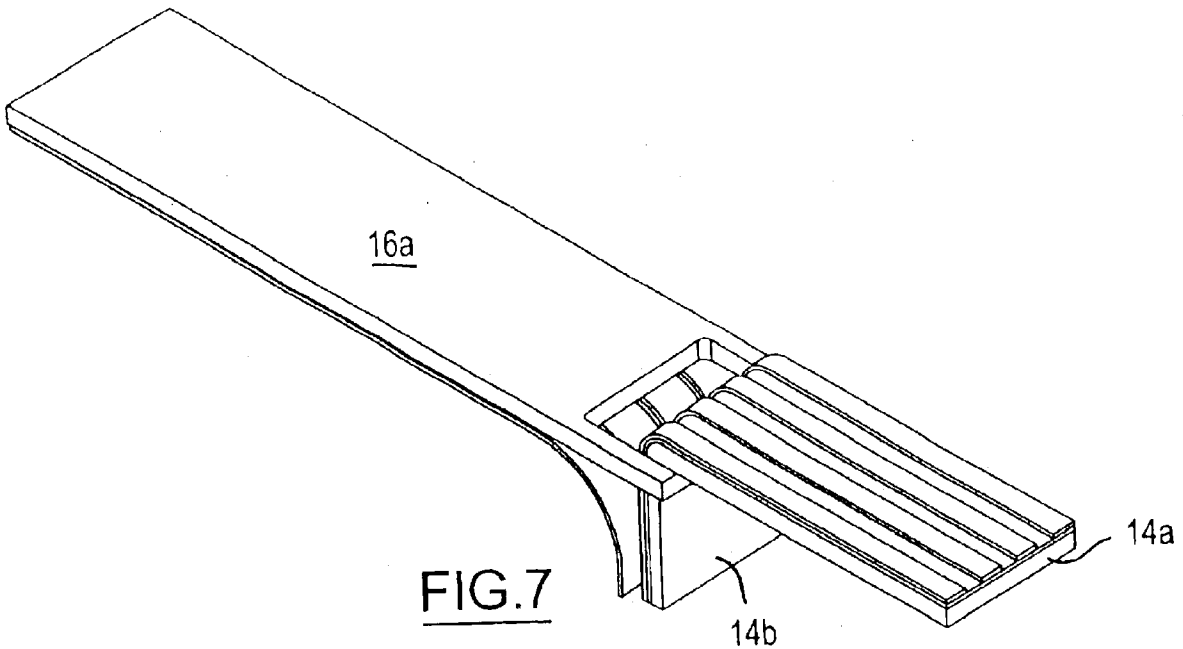
FIG. 7 is a sixth perspective view of the flexible contact connector of FIG. 1.
Figure 8:
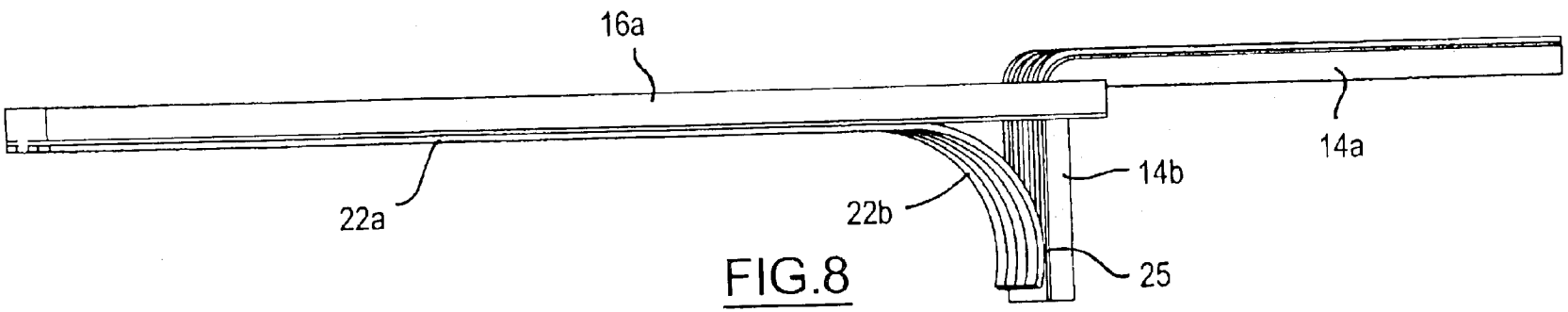
FIG. 8 is a seventh perspective view of the flexible contact connector of FIG. 1.

With reference to FIGS. 2–8, flexible connector 9 can be configured so that layers of conductive material 18 and 22 include a plurality of electrically conductive elements. For example, FIG. 2 shows a four conducting element arrangement. It should be noted that this four conducting element arrangement is for exemplary purposes only and is not meant to be limiting in nature. In reality, conductive material 18 and 22 can be configured with any number of conducting elements. In any event, in this illustrated four conducting element arrangement, first coupling member 14 includes a four conducting elements $\mathbf{18}_1$, $\mathbf{18}_2$, $\mathbf{18}_3$, and $\mathbf{18}_4$. Second coupling element 16 includes a corresponding four conducting elements $\mathbf{22}_1$, $\mathbf{22}_2$, $\mathbf{22}_3$, and $\mathbf{22}_4$. When first and second coupling members 14 and 16 are engaged, conductive portions $\mathbf{18}_1$, $\mathbf{18}_2$, $\mathbf{18}_3$, and $\mathbf{18}_4$ engage portions $\mathbf{22}_1$, $\mathbf{22}_2$, $\mathbf{22}_3$, and $\mathbf{22}_4$, respectively, thereby completing four "circuits" between locomotive 10 and tender 12 at connection point 25. Accordingly, when first and second coupling members 14 and 16 are engaged, train cars 10 and 12 (i.e., locomotive and tender) are both mechanically and electrically coupled together using one single coupling means without any extra hard wire connections or additional coupling mechanisms.

FIGS. 9–15 show an alternate embodiment of a flexible contact connector, designated 9*a*. Unless stated to the contrary, all disclosure with respect to flexible connector applies with equal force to flexible connector 9*a*.

Figure 9:
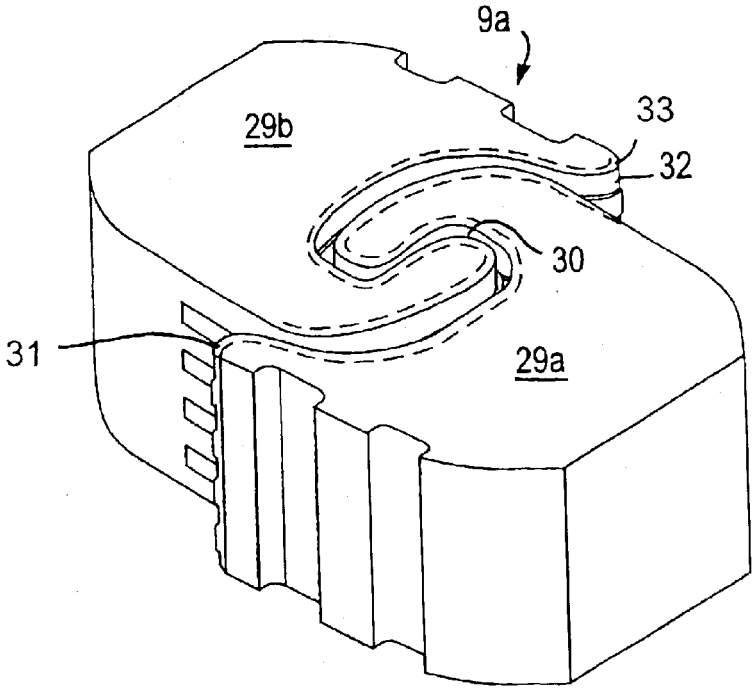
FIG. 9 is a first perspective view of an alternate embodiment of a flexible contact connector in accordance with the present invention.

With respect to FIGS. 9–15, this illustrated embodiment of flexible connector 9*a* is of an interlocking C-shape type, but also embodies the same principles of the first embodiment, namely, of flexible connector 9. FIG. 9 shows flexible connector 9*a* comprising C-shaped first and second coupling members 29*a* and 29*b* interlocked in an engaged position. As with the exemplary embodiment discussed above, first coupling member 29*a* includes a first layer of electrically conducting material 30 disposed on a portion of the surface of first coupling member 29*a*. Coupling member 29*a* may also include a first layer of insulating material 31 disposed between the surface of coupling member 29*a* and conductive material 30. Similarly, coupling member 29*b* includes a second layer of conductive material 32 disposed on a portion of the surface of coupling member 29*b*. Coupling member 29*b* may also include a second layer of insulating material 33 disposed between the surface of coupling member 29*b* and conductive layer 32.

Figure 10:
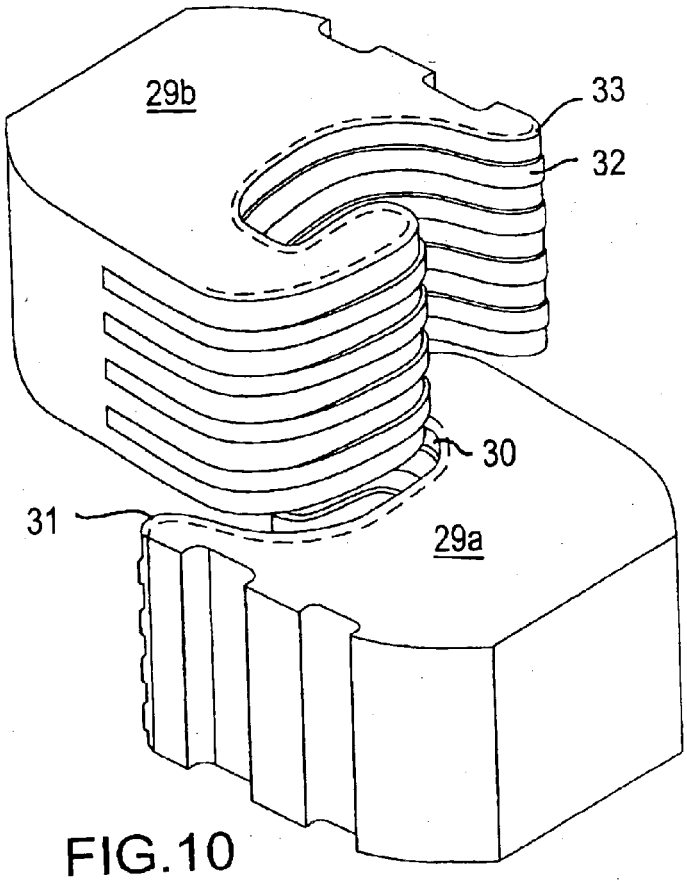
FIG. 10 is second perspective view of the flexible contact connector of FIG. 9.

With respect to FIG. 10, connector 9*a* is shown wherein first and second coupling members 29*a* and 29*b* are disengaged. When coupling members 29*a* and 29*b* are disengaged, train cars 10 and 12 are neither mechanically nor electrically coupled together. However, as shown in FIG. 9, when coupling members 29*a* and 29*b* are interlocked so as to be engaged with each other, train cars 10 and 12 are both mechanically and electrically connected without the necessity of additional wiring or other coupling mechanisms.

Figure 11:
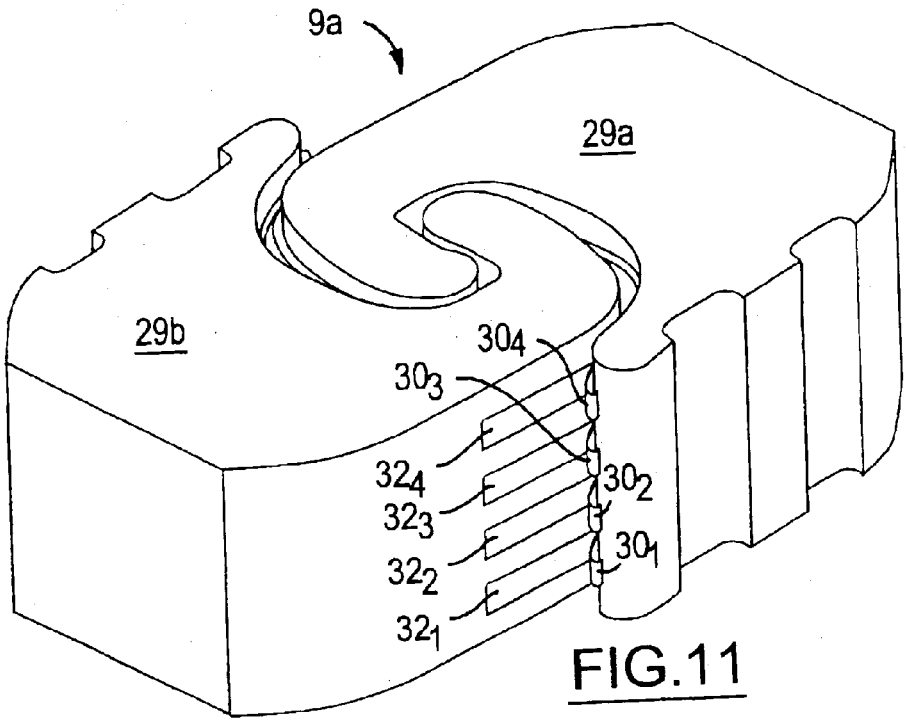
FIG. 11 is a third perspective view of the flexible contact connector of FIG. 9.

As with the exemplary embodiment illustrated in FIGS. 1–8, first and second layers of conductive material 30 and 32 of flexible connector 9*a* may also be configured with a plurality of electrically conducting elements. With reference to FIG. 11, a four conducting element arrangement is shown. As with the exemplary embodiment discussed above, this arrangement is for exemplary purposes only and not meant to be limiting in nature. In actuality layers of conductive material 30 and 32 can be configured with any given number of conducting elements. In any event, in the four conducting element arrangement illustrated in FIG. 11, conductive elements $\mathbf{30}_1$ through $\mathbf{30}_4$ are in engagement with a corresponding plurality of conductive portions $\mathbf{32}_1$ through $\mathbf{32}_4$ when first and second coupling portions 29*a* and 29*b* are engaged. This arrangement, in-effect, completes four individual electric circuits between train cars 10 and 12.

Note, in the first and second embodiments, each of the plurality of conductive elements in first and second layers of conductive material 30 and 32 are separated from each other to provide distinct electrical circuits. Intervening portions of electrically insulating material may also be disposed in between electrical elements to further enhance the electrical distinctness.

Figure 12:
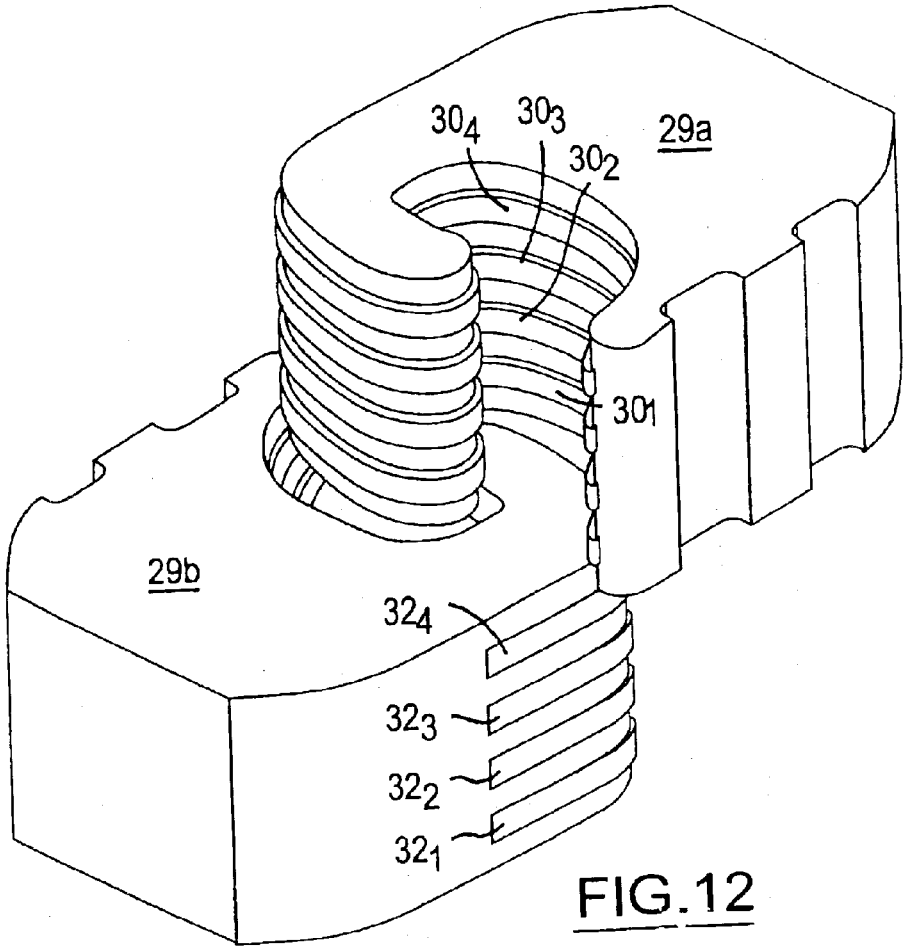
FIG. 12 is a fourth perspective view of the flexible contact connector of FIG. 9.
Figure 13:
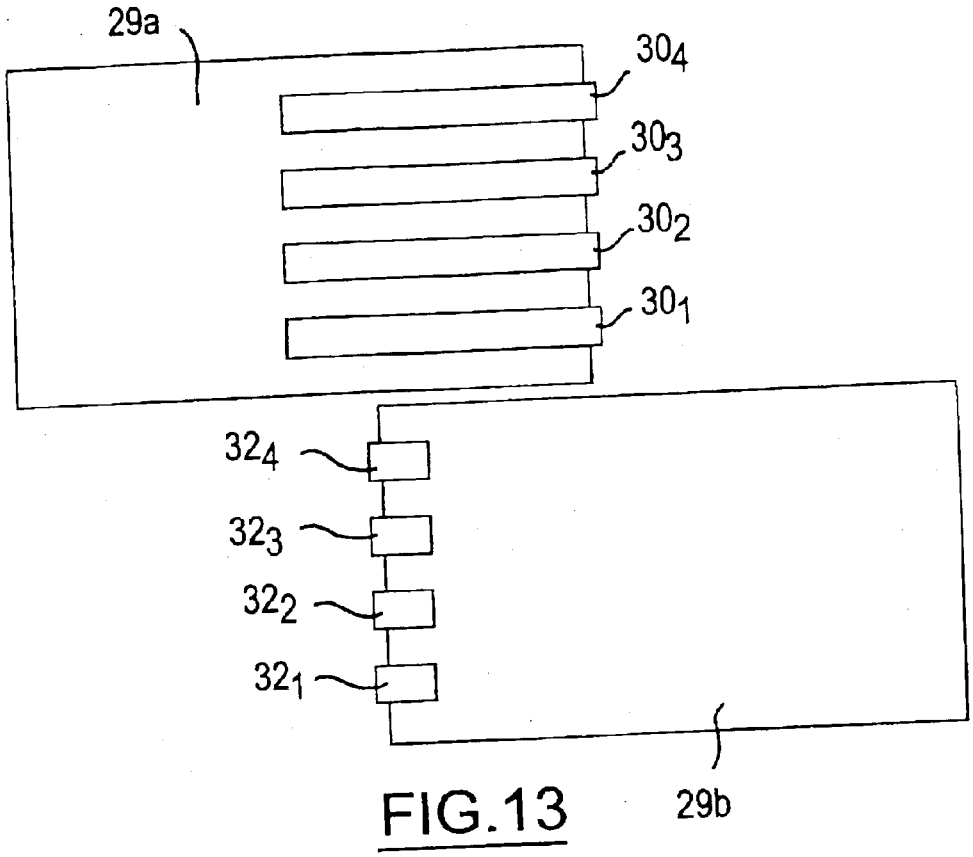
FIG. 13 is a fifth perspective view of the flexible contact connector of FIG. 9.
Figure 14:
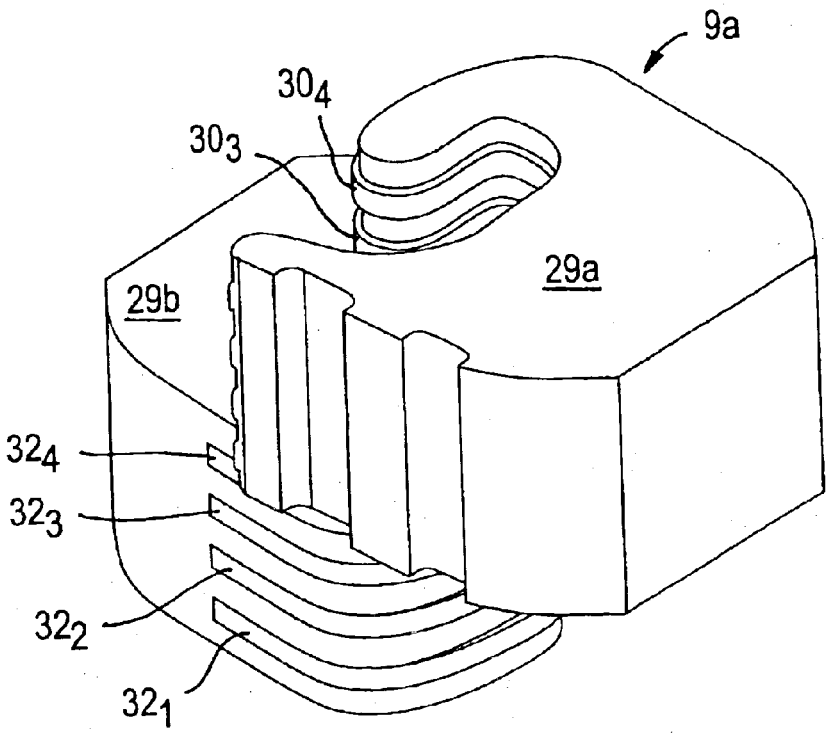
FIG. 14 is a side view of the flexible contact connector of FIG. 9.
Figure 15:
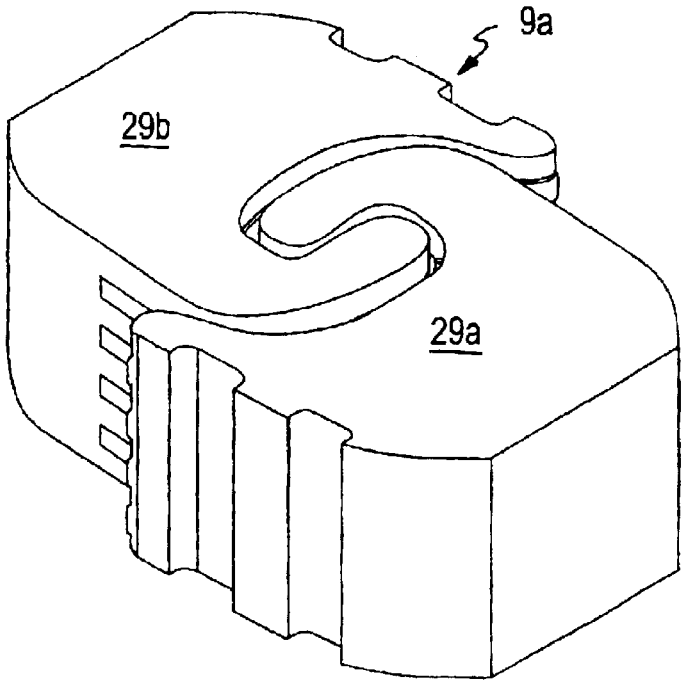
FIG. 15 is a sixth perspective view of the flexible contact connector of FIG. 9.

With respect to FIGS. 12–15, the progression engaging first and second coupling members 29*a* and 29*b* is shown. In FIGS. 12 and 13, coupling portions 29*a* and 29*b* are in a disengaged relationship. In FIG. 14, coupling members 29*a* and 29*b* are in a partially engaged relationship. In FIG. 15, coupling members 29*a* and 29*b* are in an engaged relationship.

Accordingly, with respect to FIGS. 1–15, a flexible contact connector in accordance with the present invention includes a first and second coupling member attached to a first and second train car, respectively. A first layer of conductive material is disposed on the surface of the first coupling member, and a second layer of conductive material is disposed on the surface of the second coupling member. When the first and second coupling members are placed in engagement, the first and second layers of conductive material also engage, thereby creating both a mechanical and electrical connection between the first and second train cars with a single coupling mechanism.

Figure 16:
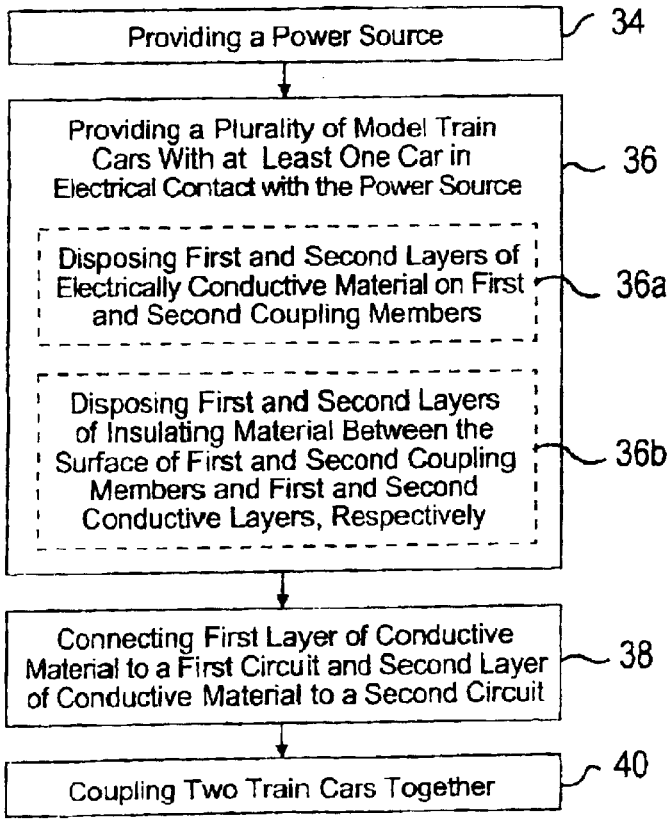
FIG. 16 is a block diagram of a method of powering an electric train in accordance with the present invention.

With respect to FIG. 16, a method of powering an electric train is shown. Step 34 comprises providing a power source. In an exemplary embodiment, the power source applies power across the rails of a three rail track, wherein the center rail is connected to the "hot" or power terminal of the power source, and the ground or neutral terminal is connected to the outside rail of the track. It should be noted, however, that this three rail track configuration is provided for exemplary purposes only and is not meant to be limiting in nature. In actuality, the inventive connector and method set forth herein can be used with other track configurations, such as, for example, two rail track systems.

Step 36 comprises providing a plurality of model train cars wherein at least one of the train cars is in electrical contact with said power source (i.e., via the center rail of the track). Step 36 further includes providing a plurality of model train cars wherein a first car has a first coupling member attached to its rear end, and the second car has a second coupling member attached to its front end so as to allow for the first and second cars to be connected together when the first and second coupling members are engaged (in step 40 discussed below). Similarly, the second car is further configured to have a first coupling member attached to its rear end, and a third car is configured to have a second coupling member attached to its front end to allow the second and third cars to be connected, and so on an so forth.

Step 36 further includes substeps 36*a* and 36*b*. Substep 36*a* comprises disposing a first and second layer of electrically conductive material on the surface of the first and second coupling members, respectively, so as to create an electrical connection between the first and second train cars, in addition to the mechanical connection, when the first and second coupling members are engaged. This conductive material may be comprised of one conducting element or a plurality of separate and distinct conducting elements. Substep 36*b* entails disposing a first and second layer of insulating material between the first and second conductive layers and the surface of the first and second coupling members, respectively.

Step 38 includes connecting the first layer of conductive material to a first circuit and the second layer of conductive material to a second circuit. In a preferred embodiment, the first layer of conductive material is connected to the power source.

Finally, step 40 provides for coupling two of the plurality of train cars together to form a train using a single connector that is operative to both mechanically and electrically connect each train car to the next adjacent train car in the train.

Accordingly, in operation, the inventive connector 9 allows two-way communication between a pair of train cars, such as a locomotive and a tender, for example, without the need of secondary physical connectors, wires, or other devices to couple the cars together. Connector 9 can be used between two intelligent cars allowing communication and/or control of physical devices such as, for example purposes only, lights, sound and movement.

For example, a locomotive receives a signal to trigger the lights and/or sounds associated with the train cars. The locomotive generates and/or transmits a signal to a lighting circuit and/or sound circuit on a tender car coupled to the locomotive by way of connector 9, thereby causing the activation or deactivation of either/or the lights and sound of the tender car. Similarly, connector 9 can be used to transfer some or all of the electrical power needed to operate model trains. A locomotive is in electrical contact with the power source of the electrical system and transfers some or all of this power to the vehicles coupled to it through connector 9 to thereby run motors or other electrical devices located on the train car coupled to the locomotive. It should be noted that these examples are provided for exemplary purposes only and are in no way meant to be limiting in nature. In reality, there are a number of other applications for this inventive connector.

While only those embodiments set forth above have been described in detail, other configurations and embodiments for the present invention exist that are within the spirit and scope of the invention.

What is claimed:

1. A connector for use in a model train, comprising:

a first coupling member associated with a first model train car;

a second coupling member associated with a second model train car, wherein said second coupling member is configured for engagement with said first coupling member;

a first layer of electrically conductive material connected to a first circuit and disposed upon the surface of said first coupling member; and a second layer of electrically conductive material connected to a second circuit and disposed upon the surface of said second coupling member, so as to result in said first and second model train cars being mechanically and electrically connected when said first and second coupling members are engaged with each other, and wherein said first and second layers of electrically conductive material are comprised of a flexible electrically conductive material.

2. A connector in accordance with claim 1 wherein said first and second layers of electrically conductive material are comprised of a resilient phosphor bronze material.

3. A connector in accordance with claim 1 wherein said first and second layers of electrically conductive material further include a plurality of electrically conductive elements.

4. A connector in accordance with claim 3 wherein said plurality of electrically conductive elements are separated by a plurality of intervening portions of insulation.

5. A connector in accordance with claim 1 further comprising:

a first layer of insulating material disposed between said first layer of electrically conductive material and the surface of said first coupling member; and a second layer of electrically conductive material disposed between said second layer of electrically conductive material and the surface of said second coupling member.

6. A connector in accordance with claim 1 wherein:

said first coupling member includes a horizontal portion having a top and a bottom side, and a vertical portion having an inner and an outer side, wherein said vertical portion is located at a distal end of said horizontal portion and is configured so as to be perpendicular thereto, thereby forming a drawbar; and said second coupling member includes a top and a bottom side and is configured horizontally so as to be parallel with said horizontal portion of said first member, said second coupling member, said aperture being configured to receive said vertical portion of said first coupling member.

7. A connector in accordance with claim 6 wherein said first and second layers of electrically conductive material further include a plurality of electrically conductive elements.

8. A connector in accordance with claim 7 wherein said plurality of electrically conductive elements are separated by a plurality of intervening portions of insulation.

9. A connector in accordance with claim 6 wherein:

said first layer of conductive material is continuously disposed on said top side of said horizontal portion and said outer side of said vertical portion of said first coupling member; and said second layer of conductive material is disposed on said bottom side of said second coupling member, said second layer further including an arcuate portion extending from said bottom side of said second coupling member to said first layer of electrically conductive material when said first and second coupling members are engaged.

10. A connector in accordance with claim 9 further comprising:

a first insulating layer disposed between said first electrically conductive layer and said top side and outer side of said horizontal and vertical portions of said first coupling member; and a second insulating layer disposed between said second electrically conductive layer and said bottom side of said second coupling member.

11. A connector in accordance with claim 1 wherein said first coupling member is attached to the rear end of said first model train car and said second coupling member is attached to the front end of said second train car so as to form a train when said first and second train cars are connected.

12. A connector in accordance with claim 1 wherein each of said first and second coupling members are formed in the shape of the letter "C" and configured so as to be interlocking when said first and second coupling members are engaged with each other, each of said first and second "C" shaped coupling members further having an inner and an outer surface.

13. A connector in accordance with claim 12 wherein said first and second layers of said electrically conductive material are disposed on a portion of the surface of each of said first and second "C" shaped coupling members so as to be in electrical contact when said coupling members are engaged.

14. A connector in accordance with claim 13 further comprising:

a first layer of insulating material disposed between said inner surface of said first coupling member and said first layer of electrically conductive material; and a second layer of insulating material disposed between said inner surface of said second coupling member and said second layer of electrically conductive material.

15. A connector in accordance with claim 13 wherein each of said first and second layers of electrically conductive material include a plurality of electrically conductive elements.

16. A connector in accordance with claim 15 wherein said plurality of electrically conductive elements are separated by a plurality of intervening portions of insulating material.

17. A connector in accordance with claim 12 wherein said first coupling member is attached to the rear end of said first model train car and said second coupling member is attached to the front of said second model train car so as to form a train when said first and second train cars are connected.

* * * * *